US008521076B2

(12) United States Patent
Masuda

(10) Patent No.: US 8,521,076 B2
(45) Date of Patent: Aug. 27, 2013

(54) IMAGE FORMING APPARATUS INCLUDING COOLING MECHANISM FOR COOLING HEATED SHEET

(75) Inventor: Junya Masuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 239 days.

(21) Appl. No.: 12/882,278

(22) Filed: Sep. 15, 2010

(65) Prior Publication Data

US 2011/0081176 A1 Apr. 7, 2011

(30) Foreign Application Priority Data

Oct. 5, 2009 (JP) ..... 2009-231514

(51) Int. Cl.
*G03G 21/20* (2006.01)

(52) U.S. Cl.
USPC ..... 399/341

(58) Field of Classification Search
USPC ..... 399/341, 405
See application file for complete search history.

(56) References Cited

U.S. PATENT DOCUMENTS

| | | | |
|---|---|---|---|
| 7,433,623 | B2 | 10/2008 | Nakamura et al. |
| 7,558,502 | B2 | 7/2009 | Kanai |
| 2007/0280721 | A1 | 12/2007 | Kanai |

FOREIGN PATENT DOCUMENTS

| | | | | |
|---|---|---|---|---|
| JP | 03-196175 | A | | 8/1991 |
| JP | 04-306686 | | | 10/1992 |
| JP | 04306686 | A | * | 10/1992 |
| JP | 04345187 | A | * | 12/1992 |
| JP | 08-171338 | A | | 7/1996 |
| JP | 2003-307959 | | | 10/2003 |
| JP | 2003-307959 | A | | 10/2003 |
| JP | 2005-241934 | A | | 9/2005 |
| JP | 2006-106668 | A | | 4/2006 |
| JP | 2006-330398 | A | | 12/2006 |
| JP | 2007-086310 | A | | 4/2007 |
| JP | 2007-322470 | A | | 12/2007 |
| JP | 2009-227303 | A | | 10/2009 |
| JP | 2009-231853 | A | | 10/2009 |
| JP | 2009-232145 | A | | 10/2009 |

* cited by examiner

*Primary Examiner* — Quana M Grainger
(74) *Attorney, Agent, or Firm* — Renner, Otto, Boisselle & Sklar, LLP

(57) ABSTRACT

An image forming apparatus includes an image forming portion that forms an image on a recording medium, a fixing portion that heats and fixes an image on a recording medium after forming the image, a feed path that conveys a recording medium after heating and fixing by the fixing portion, a first pair of feed rollers composed of two feed rollers provided in the feed path, and a cooling mechanism that sends cooling air to a nip portion of the pair of feed rollers or to the vicinity thereof. The cooling mechanism increases a cooling air volume when a recording medium is held between the first pair of feed rollers in comparison to the time when the recording medium is not held between the first pair of feed rollers.

11 Claims, 9 Drawing Sheets

FIG. 3
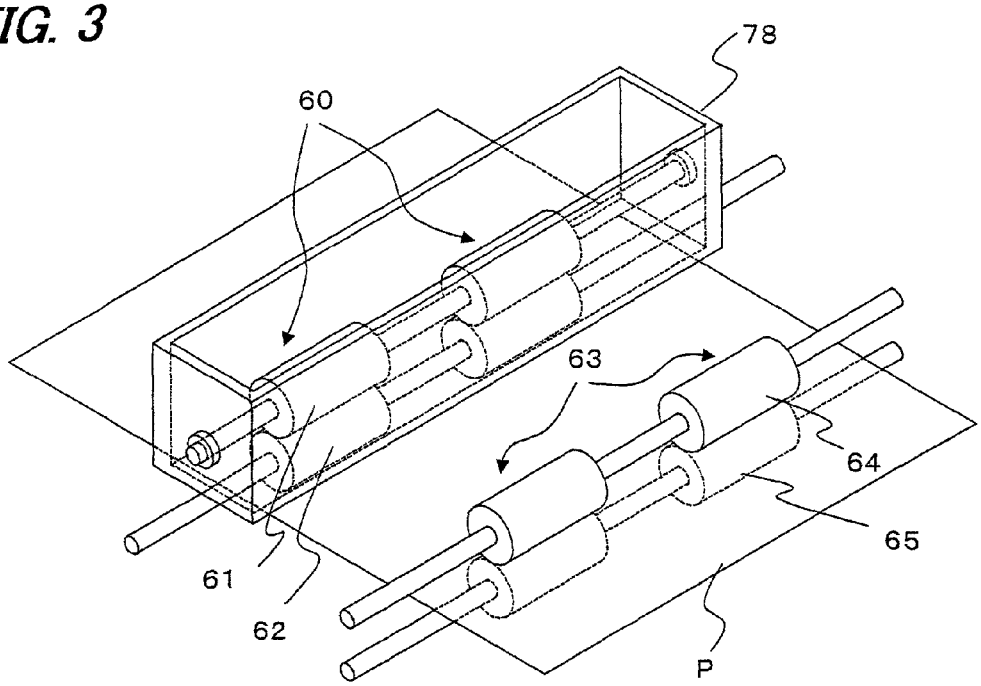
FIG. 4A
FIG. 4B
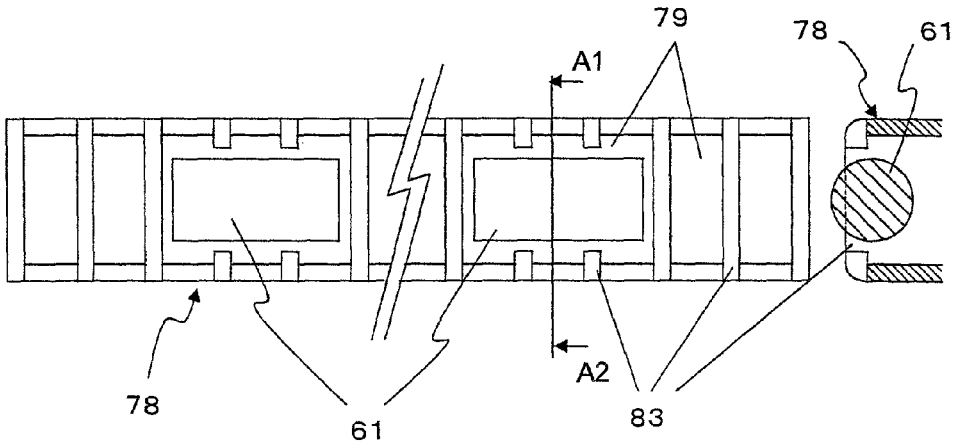

IMAGE FORMING APPARATUS INCLUDING COOLING MECHANISM FOR COOLING HEATED SHEET

This Nonprovisional application claims priority under 35 U.S.C. §119(a) on Patent Application No. 2009-231514 filed in Japan on 5 Oct. 2009, the entire contents of which are hereby incorporated by reference.

BACKGROUND OF THE INVENTION

1. Field of the Invention

The present invention relates to an image forming apparatus such as a copier, a printer and a facsimile apparatus employing the electrophotographic method, and particularly, relates to an image forming apparatus that cools down a sheet heated by a fixing portion.

2. Description of the Prior Art

In an electronic copying image forming apparatus, a toner image formed on a photoreceptor is transferred onto a sheet at a transfer portion. The sheet onto which the toner image is transferred is sent to the fixing portion, to which heat and pressure is applied at the fixing portion, and the toner image is thereby fixed on the sheet. Thereafter, the sheet is discharged to a paper output tray from a discharge portion and stacked on the paper output tray.

However, when the sheet is discharged as it is without being cooled down, the sheet stacked on the paper output tray is not sufficiently cooled down so that a phenomenon has occurred such that the surfaces of the sheets stacked on the paper output tray that lie next to each other are adhered by toner due to a high temperature (hereinafter, such a phenomenon is referred to as a sticking phenomenon). The sticking phenomenon has notably occurred at the time of duplex printing, at the time of high-speed printing and at the time of printing that uses a low-melting-point toner.

For reducing such a sticking phenomenon, it is considered that a feed path length from the fixing portion to the paper output tray is extended to gain a cooling time, however, miniaturization of an image forming apparatus has been advanced as seen in recent years, and it has been thus impossible to employ this method.

Consequently, when a sheet after passing through the fixing portion is conveyed by a pair of feed rollers in a feed path, cooling down of the sheet is performed by blowing air.

However, in image forming apparatuses that are described in Patent Literature 1 (Japanese Patent Application Laid-open Hei 8 No. 171338) and Patent Literature 2 (Japanese Patent Application Laid-open No. 2006-106668), an air blowing timing and an air volume for the sheet in the feed path are not considered. Hence, an influence on conveying performance of the sheet such as curing up of a tip end of the sheet, bending and tearing up of the sheet due to the tip end of the sheet not being appropriately put into a nip of the pair of the rollers, and a paper jam, by blowing air to the sheet, is not considered.

SUMMARY OF THE INVENTION

The present invention has been made in view of the circumstances as described above, and is to provide an image forming apparatus that cools down a sheet by blowing air in a feed path to cool down the sheet promptly and prevents a sticking phenomenon on a paper output tray, as well as capable of preventing from curling up of the sheet, bending of the sheet, tearing up of the sheet and a jam of the sheet by exerting an influence on conveying performance of the sheet by blowing air to the sheet in the feed path.

An image forming apparatus according to the present invention includes: an image forming portion that forms an image on a recording medium; a fixing portion that heats and fixes an image on the recording medium after forming the image; a feed path that conveys the recording medium after heating and fixing by the fixing portion; a first pair of feed rollers composed of two feed rollers provided in the feed path; and a cooling mechanism that sends cooling air to a nip portion of the pair of feed rollers or to the vicinity thereof, and it is characterized in that the cooling mechanism increases a cooling air volume when the recording medium is held between the first pair of feed rollers in comparison to the time when the recording medium is not held between the first pair of feed rollers.

Moreover, the cooling mechanism includes a cooling fan that blows the cooling air and a cooling duct that guides the cooling air to the first pair of feed rollers.

Thus, it is possible to prevent occurrence of conveyance defects in the sheet (curling up of the sheet, bending of the sheet, a jam, etc.) by which the sheet is curled up with the cooling air before a recording medium (hereinafter, referred to as "sheet" in some cases) is held between the first pair of feed rollers, while performing cooling down of the sheet. Further, in comparison to the case of cooling down the sheet by blowing air between two pairs of feed rollers, it is possible to shorten a feed path length required for arranging a means for cooling to contribute to miniaturization of an image forming apparatus.

Additionally, it is characterized in that the cooling duct rotatably and integrally supports a driven roller which is one feed roller of the first pair of feed rollers.

Thus, a simpler structure is achieved, and it is possible to promote efficiency of assembly and reduction of parts.

Further, it is characterized in that a second pair of feed rollers is provided on the downstream side of a feed direction of the recording medium with respect to the first pair of feed rollers, and the cooling mechanism further increases the cooling air volume when the recording medium is held between the first and the second pair of feed rollers.

Thus, since the sheet is held between both pairs of feed rollers, it is possible to further cool down the sheet without occurrence of a defect in conveying performance of the sheet even when the cooling air volume is further increased.

Additionally, it is characterized in that the cooling mechanism changes the cooling air volume depending on a type of the sheet.

Therefore, a setting value of a blowing air volume is changed depending on a type of the sheet (sheet size, sheet thickness and a grain direction of the sheet (a fiber direction is parallel to or orthogonal to the feed direction, etc.), and it is thus possible to prevent a defect in conveying performance more securely at the time of cooling down the sheet by blowing air.

Moreover, it is characterized in that the cooling mechanism blows the cooling air so as to be blown toward the upstream side of the feed direction from the first pair of feed rollers.

Thus, it is possible to further prevent curling up of the sheet in comparison to the case of blowing directly to the upstream side of a nip of a single feed roller so that the conveyance defects hardly occur, and when air is blown in the direction opposite to the direction in which the sheet moves, air flows to the upstream side from the tip end side of the sheet so that cooling efficiency is high.

Additionally, it is characterized in that a feed roller of the first pair of feed rollers, which is located on the side to which the cooling air blows, has a structure alternately having a part in contact with the recording medium and a part with a space from the recording medium thereto.

Thus, it is possible to prevent declining of the cooling efficiency of a part of the sheet to which air hardly blows due to blocking of the air by the roller. Moreover, there is no need of higher blowing air pressure with the roller as resistance.

Further, it is characterized in that the feed path includes a right after fixation feed path that conveys the recording medium right after heating and fixing by the fixing portion and a discharge feed path that connects to the right after fixation feed path to convey to an output port, and the first pair of feed rollers is provided in the discharge feed path.

Thus, the cooling mechanism is provided in the discharge feed path that departs from the fixing portion, and it is possible to suppress an influence of lowering of the temperature at the fixing portion.

Additionally, it is characterized in that the discharge feed path is also connected to a duplex feed path for performing duplex printing to be used as a switchback path, and a recording medium whose one side is printed with a duplex printing mode is cooled down during a carrying-in period to the switchback path and during a carrying-out period from the switchback path.

Thus, a sheet that returns into the apparatus by being subjected to switchback with the duplex printing mode is sufficiently cooled down so that heat is not accumulated in the apparatus.

Furthermore, it is characterized in that the right after fixation feed path extends in an approximately vertical direction from the fixing portion, and the discharge feed path is arranged in an approximately horizontal direction to connect to the right after fixation feed path.

Thus, in the discharge feed path that is connected to the right after fixation feed path that extends in the approximately vertical direction to be arranged in the approximately horizontal direction, a cooling mechanism is arranged so that the upstream fixing portion departs from the cooling mechanism, and air that is blown to a cooling sheet thus hardly flows in the vicinity of the fixing portion so that it is prevented from power being wasted for keeping the temperature of the fixing portion.

Additionally, it is characterized in that in the discharge feed path, a predetermined length of a plane part of the feed path is provided between a connection portion to the right after fixation feed path and an installation position of the first pair of feed rollers.

Thus, the flat part with the predetermined length is provided between the connection portion and the pair of feed rollers so that air that moves to the upstream side with respect to the pair of feed rollers enables to cool down the sheet and the cooling efficiency thus grows.

According to the present invention, when the sheet is cooled down by blowing the cooling air at predetermined air volume around a nip of the first pair of feed rollers (or toward the first pair of feed rollers), the cooling air is not blown or the cooling air volume is diminished before the tip end of the sheet is held between nips so that it is possible to prevent occurrence of conveyance defects of the sheet by curling up the sheet with the cooling air and the like, while performing cooling down of the sheet.

BRIEF DESCRIPTION OF THE DRAWINGS

FIG. 3 is a perspective view showing the first embodiment of the cooling mechanism in the second feed path;

FIG. 4A is a plan view of a cooling duct of the first embodiment, and FIG. 4B is a cross-sectional view in a view indicated by arrows A1-A2 of FIG. 4A;

DESCRIPTION OF THE PREFERRED EMBODIMENTS

Description will be hereinafter given for embodiments of the present invention with reference to accompanying drawings. Note that, the following embodiments are examples that embody the present invention and are not to limit the technical scope of the present invention.

Figure 1:
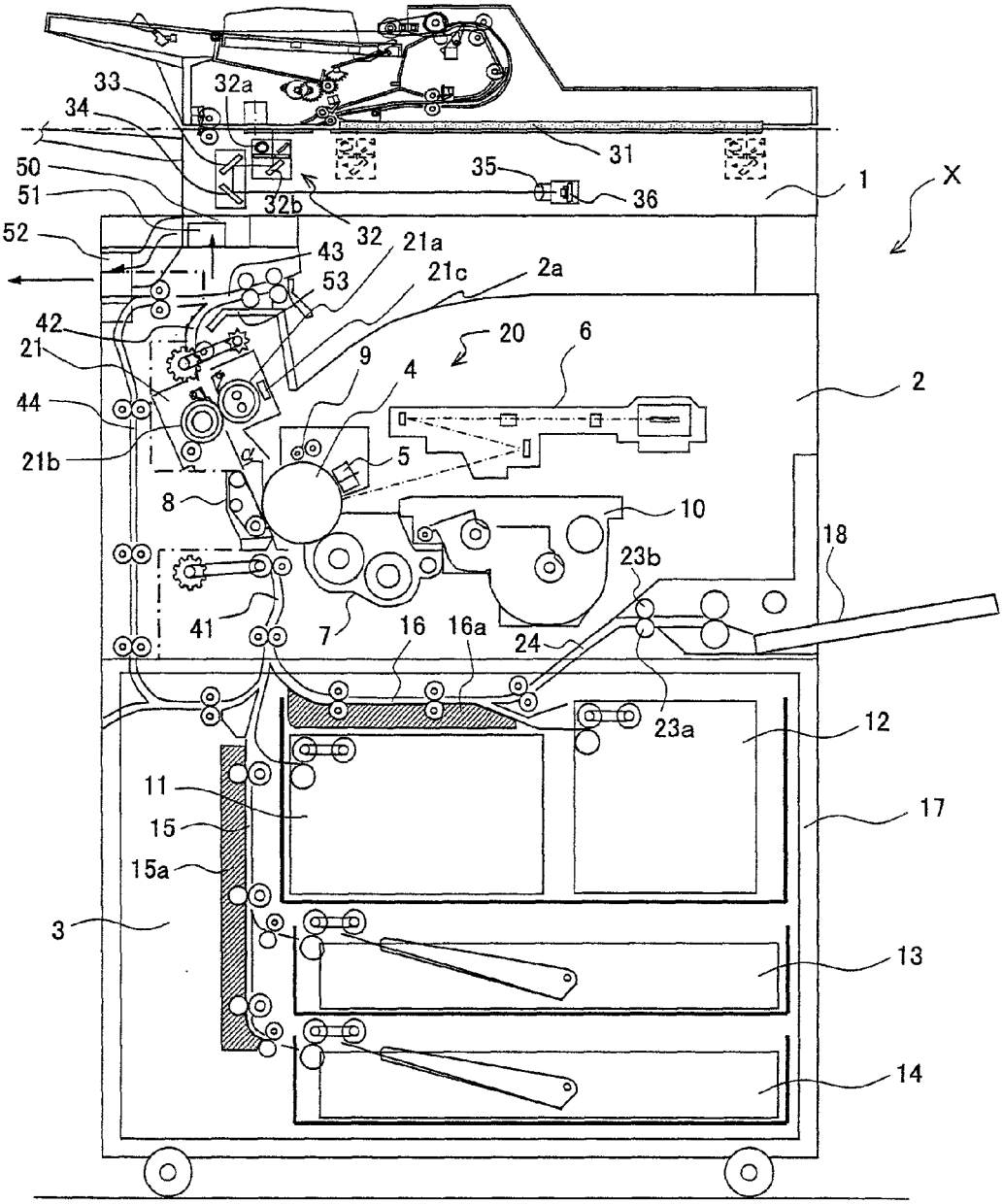
FIG. 1 is a schematic cross-sectional view showing a configuration of an image forming apparatus according to an embodiment of the present invention.

Here, FIG. 1 is a schematic cross-sectional view showing a configuration of an image forming apparatus X according to an embodiment of the present invention.

First, description will be given for the configuration of the image forming apparatus X according to one embodiment of the present invention with use of FIG. 1. The image forming apparatus X is a multi-functional peripheral having both a copy function and a printer function.

Figure 5:
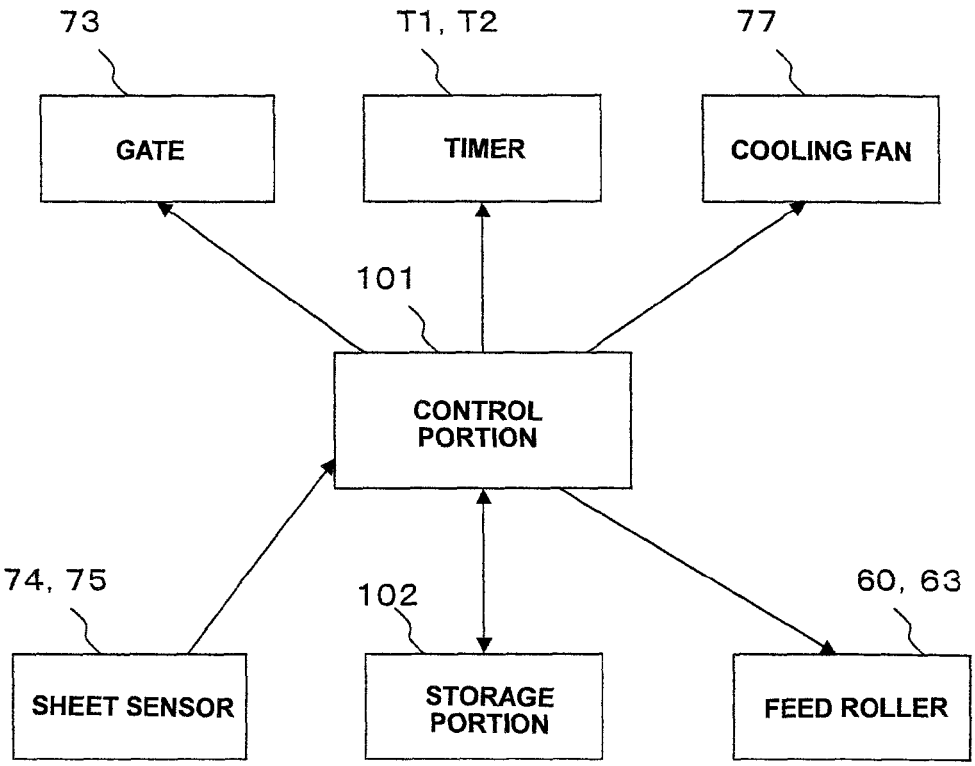
FIG. 5 is a block diagram related to the cooling mechanism of the image forming apparatus.

The image forming apparatus X includes a copier mode (copy mode) as a print mode, a printer mode and a fax mode, and an operation input from a not-shown operation portion and a print mode corresponding to reception of a print job from an external host apparatus such as a personal computer are selected by a control portion 101 of FIG. 5.

As shown in FIG. 1, the image forming apparatus X is provided with main portions of a document reading portion 1 of an uppermost part, a printer portion (image forming portion) 2 arranged beneath thereof and a paper supply unit portion 3 arranged further beneath thereof.

The document reading portion 1, after input of condition input keys (number of printed sheets/printing magnification, etc.) on an operation panel (not shown) arranged on an external front surface of the apparatus, starts copy action when a start key of the operation panel is operated and reads an image of a document placed on a platen glass 31. That is, a copy lamp 32*a* (light source) of a copy lamp unit 32 is lighted, and exposure to the document is started while the copy lamp unit 32 horizontally moves. An irradiation light irradiated to the document with the copy lamp 32*a* becomes a reflected light including image information of the document (reflected light from the document), and the reflected light is read by being input from a first mirror 32*b* provided in the copy lamp unit 32, to a second mirror 33, a third mirror 34, and from a optical lens 35 to a CCD 36.

For the image information read in this manner, light image information is converted into an electrical signal in a CCD circuit provided in the control portion 101 (FIG. 5), and for the image information signal, image processing is performed on the set conditions to be transmitted to a light scanning unit 6 as print data.

The printer portion 2 includes an electrophotographic process portion 20 that performs image formation on a recording medium (sheet) with developer (toner) and a fixing unit 21 (fixing portion) that heats and fixes an image (toner image) on a recording medium by sandwiching the recording medium after image formation between a fixing roller 21*a* (heating roller) and a pressing roller 21*b*.

A heater is provided inside the fixing roller 21*a*, and supplying power to the heater is controlled by the control portion 101 (FIG. 5) so as to keep a detected temperature of a temperature sensor 21*c* that detects the temperature of the fixing roller 21*a*, at a predetermined fixing temperature.

The electrophotographic process portion 20 includes a photoreceptor drum 4, a charging unit 5 that is arranged in the circumference around the photoreceptor drum 4, a light scanning unit 6, a developing unit 7, a transfer unit 8 and a cleaning unit 9.

The charging unit 5 is to charge uniformly on the surface of the photoreceptor drum 4.

The light scanning unit 6 is to scan an optical image on the photoreceptor drum 4 uniformly charged to write an electrostatic latent image.

The developing unit 7 is to visualize with developer the electrostatic latent image written according to print data by the light scanning unit 6.

Further, the transfer unit 8 is to transfer an image that is recorded and reproduced on the photoreceptor drum 4 onto a recording medium such as a recording sheet.

The cleaning unit 9 is to remove the developer that remains on the photoreceptor drum 4 to enable a new image to be recorded on the photoreceptor drum 4.

The residual developer removed by the cleaning unit 9 is collected by a developer supply portion 10 of the developing unit 7 to be recycled. Note that, the image forming apparatus according to the present invention is not limited to an apparatus provided with a process that recycles the residual developer in this manner but may be an image forming apparatus that collects and disposes the residual developer.

Moreover, the paper supply unit portion 3 is provided with paper supply trays (recording medium supply portions) 11, 12, 13 and 14 in which a plurality of recording media (recording sheets, etc.) are set, whereby a variety of sheets as recording media are, for example, sorted by each of the paper supply trays 11 to 14 by size to be contained.

The paper supply tray 11 and the paper supply tray 12 are arranged parallel to each other, the paper supply tray 13 is arranged beneath thereof, and the paper supply tray 14 is arranged beneath thereof. Here, each capacity of the paper supply tray 13 and the paper supply tray 14 is configured so as to be set to approximately the same capacity. On the other hand, each capacity of the paper supply tray 11 and the paper supply tray 12 is configured so as to be set to the capacity larger than that of the paper supply tray 13 and the paper supply tray 14.

Then, the paper supply unit portion 3, for conveying a sheet (recording medium) contained in the paper supply trays 11 to 14 toward the printer portion 2, is provided with a fourth feed path 15 and a fifth feed path 16.

The fourth feed path 15 is to convey a sheet contained in the paper supply trays 11, 13 and 14 toward the printer portion 2.

The fifth feed path 16 is to convey a sheet contained in the paper supply tray 12 toward the printer portion 2.

Additionally, the fourth feed path 15 extends in an approximately vertical direction along a frame 17 of the paper supply unit portion 3. On the other hand, the fifth feed path 16 extends in an approximately horizontal direction along the frame 17. In this manner, the paper supply trays 11 to 14, the fourth feed path 15 and the fifth feed path 16 are efficiently arranged inside the paper supply unit portion 3, and space-saving of the paper supply unit portion 3 is realized.

Note that, when a sheet is placed in each of the paper supply trays 11 to 14, replenishment of a sheet is performed by pulling an intended tray of the paper supply trays 11 to 14 out in a front direction of a body of the image forming apparatus X.

When image formation is performed on a recording medium in the image forming apparatus X, one tray is selected from among the paper supply trays 11 to 14, and sheets are separately carried out from the selected tray sheet by sheet.

A sheet (recording medium) carried out (supplied) from the paper supply trays 11 to 14 is conveyed in an upper direction of a third feed path 41 after going through the fourth feed path 15 or the fifth feed path 16 to be supplied between the photoreceptor drum 4 and the transfer unit 8.

Then, an image recorded and reproduced on the photoreceptor drum 4 is transferred onto the supplied sheet by the transfer unit 8.

The sheet after image formation is conveyed to the fixing unit 21 (fixing portion) arranged further upward, and a toner image is heated and fixed at the fixing unit 21.

Subsequently, the sheet after heating and fixing by the fixing unit 21 is sent into a first feed path 42 (right after fixation feed path) and thereby guided further upward, and then conveyed to a second feed path 43 arranged in an upper direction of the fixing unit 21.

The second feed path 43 is, as described below, a discharge feed path as well as a switchback feed path in duplex printing.

The second feed path 43 is a path that causes a sheet that passes through the first feed path 42 (sheet after heating and fixing) to change the direction to an approximately horizontal direction to convey, whereby a sheet is discharged to a paper output tray 2*a* outside the apparatus or sent to a post-processing apparatus (not shown), or the sheet is recirculated to a sixth feed path (duplex feed path) 44 with switchback so that image formation is performed onto both sides of the sheet.

In the case of a type, like the image forming apparatus X, that performs heating and fixing while conveying a sheet upward, the sheet moves upward (conveyed upward) while high-temperature air that is generated at the fixing unit 21 also moves upward, and the sheet after heating and fixing is thus hardly cooled down.

Further, a part that is a stop position of the copy lamp unit 32 in the document reading portion 1 (one example of the image reading means) is arranged in an upper direction of the first feed path 42 and the second feed path 43 (that is, upper side of the fixing unit 21) so that air heated by the fixing unit 21 is moved upward, thereby easily causing an abnormally high temperature, which causes troubles in the copy lamp unit 32.

Consequently, the image forming apparatus X is configured such that an exhaust duct 51 is arranged between the second feed path 43 and a (stop position) part of the copy lamp unit 32 of the document reading portion 1 so that air above the second feed path 43 is forcibly exhausted through the exhaust duct 51.

That is, the air above the second feed path 43 is guided to a side surface of the image forming apparatus X (left side surface in FIG. 1) from an opening provided beneath thereof by the exhaust duct 51 and forcibly exhausted to the outside of the apparatus (other position) by the exhaust fan 52 provided on the side surface thereof (the exhaust duct 51 and the exhaust fan 52 are examples of the exhausting means).

Since the exhaust duct 51 is arranged via the second feed path 43 with respect to the fixing unit 21, the second feed path 43 and a sheet that passes therethrough serves as a blocking member against movement of air around the fixing unit 21. According to such a configuration, in comparison to the case where an exhaust duct is arranged near the fixing unit 21 in the conventional manner, heat is not taken away (cooled down) from the fixing unit 21 beyond necessity, as well as power consumption of (a heater of) the fixing unit 21 is not increased in order to keep a fixing temperature.

Note that, the exhaust duct 51 in the present embodiment is to guide air to the outside (side surface) of the apparatus from a position above the second feed path 43, however, in the case where space allows, for example, it is also considered that configuration is made such that all or a part of the air of the position above the second feed path 43 are circulated into the fixing unit 21 (one example of the other position) so that further power saving of the fixing unit 21 is achieved.

Here, the exhaust duct 51 is formed with a supporting member 50 that supports the document reading portion 1 (image reading means).

The second feed path 43 is provided with a cooling mechanism for cooling down a sheet, which will be described in detail below.

First Embodiment

Figure 2:
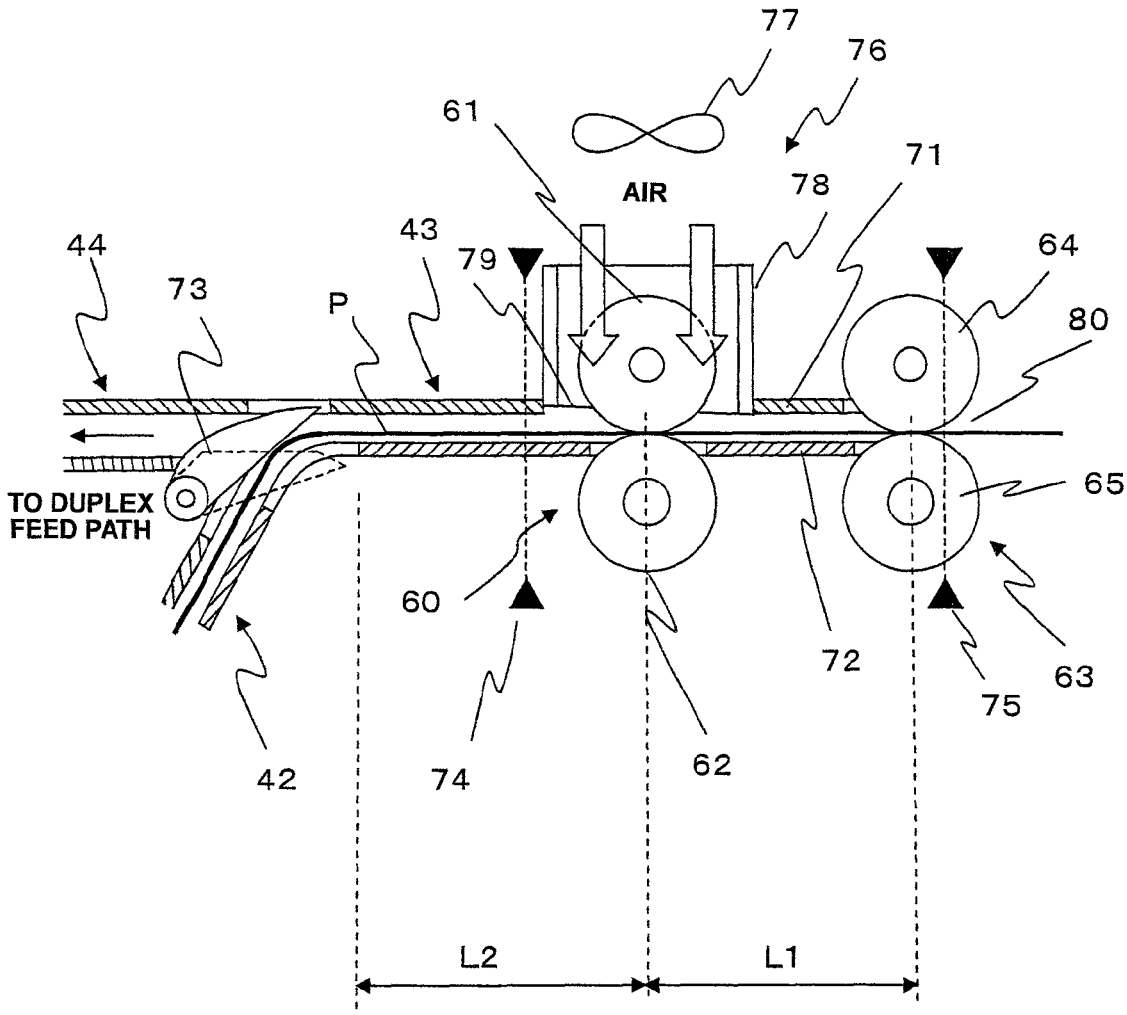
FIG. 2 is a configurational view showing a first embodiment of a cooling mechanism in a second feed path.

FIG. 2 is a configurational view showing a first embodiment of a cooling mechanism in a second feed path 43, FIG. 3 is a perspective view showing the first embodiment of the cooling mechanism in the second feed path 43, and FIG. 4A and FIG. 4B are diagrams showing a cooling duct of the first embodiment. FIG. 4A is a plan view of the cooling duct, and FIG. 4B is a cross-sectional view in a view indicated by arrows A1-A2.

Each of feed paths 42, 43 and 44 is composed of an upper feed guide 71 and a lower feed guide 72, and a sheet P is conveyed between the upper feed guide 71 and the lower feed guide 72.

The second feed path 43 is provided with a first pair of feed rollers 60 and a second pair of feed rollers 63 at a predetermined interval, and a tip of the pair of second feed rollers 63 is an output port 80.

An interval L1 between a nip of the first pair of feed rollers 60 and a nip of the second pair of feed rollers 63 is set to be shorter than a length of a minimum sheet size to be used.

The first pair of feed rollers 60 is configured with a driven roller 61 on an upper side and a driving roller 62 on a lower side. The second pair of feed rollers 63 is configured with a driven roller 64 on an upper side and a driving roller 65 on a lower side.

As shown in FIG. 3, the first pair of feed rollers 60 and the second pair of feed rollers 63 are provided by two pairs respectively in a direction in which rotation shafts of the rollers extend (rotation shaft direction; sheet width direction).

The sheet P is held between the driven rollers 61 and 64 and the driving rollers 62 and 65, and is conveyed to the output port 80 by rotation driving of the driving rollers 62 and 65.

Furthermore, as shown in FIG. 2, a plane part is provided horizontally at least for a predetermined length L2 from a connection portion of the first feed path 42 and the second feed path 43 to the first pair of feed rollers 60. This is to make cooling air easily flow to an upstream side with respect to a sheet feed direction along the second feed path 43, thereby aiming to increase a cooling down effect of a sheet conveyed from the upstream side of the sheet feed direction.

Furthermore, to the second feed path 43, the first feed path 42 for conveying a sheet from a fixing unit and a sixth feed path 44 for performing backside printing of a sheet by switching back the sheet to be recirculated are connected. Then, a gate 73 is attached to the connection part.

The gate 73 is attached so as to be rotatable, as shown in FIG. 2, is rotated in an upper direction so that the feed path 42 and the feed path 43 are in communication with each other (this position of the gate 73 serves as a first position), and is rotated in a lower direction so that the feed path 43 and the feed path 44 are in communication with each other (this position of the gate 73 serves as a second position), so as to be capable of guiding a sheet.

On the upstream side of the sheet feed direction of the first pair of feed rollers 60, a first sheet sensor 74 is provided, and on the downstream side of the sheet feed direction of the second pair of feed rollers 63, a second sheet sensor 75 is provided.

These sheet sensors 74 and 75 each of which has a light emitting portion and a light receiving portion on an upside and a downside of the second feed path 43 which is held therebetween, detects presence/absence of a sheet in the feed path.

The first sheet sensor 74 shares a timing sensor of the switchback of the sheet.

The second sheet sensor 75 detects completion of an output of a sheet by detecting a feed rear end of the sheet.

Note that, the sheet sensor may be a sensor of another detection method such as an actuator type or the like.

On the second feed path 43, a cooling mechanism 76 is provided to blow cooling air to the sheet to be conveyed to cool down.

The cooling mechanism 76 has a cooling fan 77 and a cooling duct 78.

The cooling duct 78 is disposed to surround the driven roller 61 of the first pair of feed rollers 60 so that air from the outside of an image forming apparatus X, for example, is guided to the sheet P which is being conveyed.

As shown in FIG. 3 and FIG. 4, the cooling duct 78 is a frame body of a rectangular shape. A width of the cooling duct 78 with respect to the sheet feed direction comes in a size in which the driven roller 61 is able to be fitted. A length of the cooling duct 78 with respect to a direction orthogonal to the sheet feed direction has a size in which an entire width (a sheet width in a direction orthogonal to the feed direction) of the sheet is able to be cooled down.

At an air blowing out port 79 of the cooling duct 78, as shown in FIG. 4A and FIG. 4B, a plurality of ribs 83 extending along the sheet feed direction are formed intermittently leaving a predetermined interval therebetween. The rib 83 also functions as a feed guide of the sheet P.

Further, the cooling duct 78 rotatably and integrally supports the driven roller 61, and simplifies a configuration thereof.

As shown in FIG. 2, at an installation part of the driven roller 61 on the upper feed guide 71, an opening for attaching the cooling duct 78 is formed. From the opening, cooling air guided by the cooling duct 78 is sent into the second feed path 43, and thus the sheet held between the first pair of feed rollers 60 is cooled down. Air for cooling down is, for example, taken in from the outside of the image forming apparatus X, and sent into the cooling duct 78 from the cooling fan 77.

FIG. 5 is a block diagram related to the cooling mechanism of the image forming apparatus X.

The image forming apparatus X is controlled by the control portion 101 as described above. That is, the control portion 101 controls the pair of feed rollers 60 and 63, sheet sensors 74 and 75, the gate 73, and the cooling fan 77 in accordance with values detected by the sheet sensors 74 and 75 and setting values which have been registered in a storage portion 102 in advance. Further, the control portion 101 sets timers T1 and T2 which will be described below.

Next, description will be given for cooling operation by the cooling mechanism.

Figure 6:
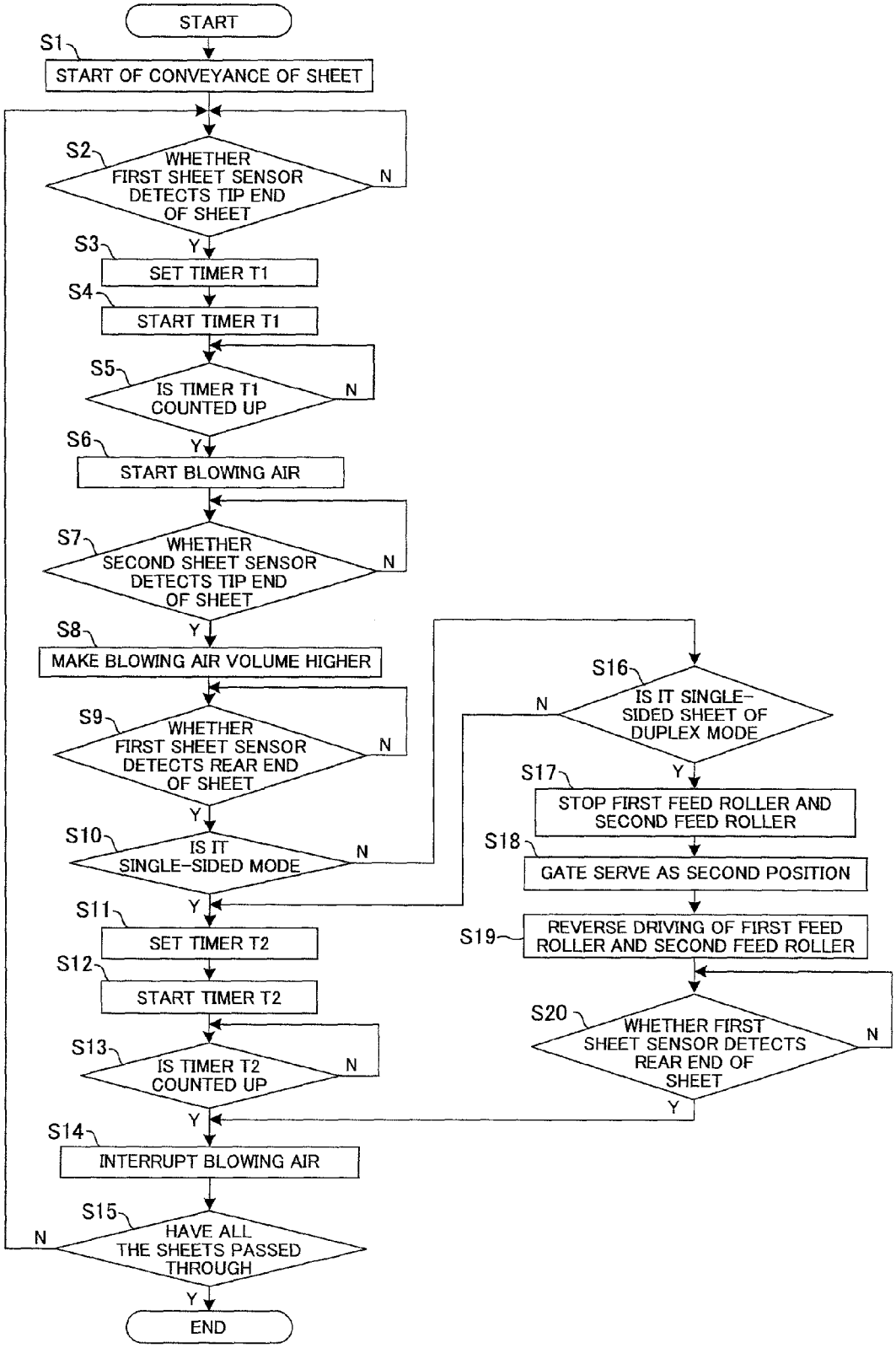
FIG. 6 is a flow chart showing procedures of cooling down of a sheet.
Figure 7A:
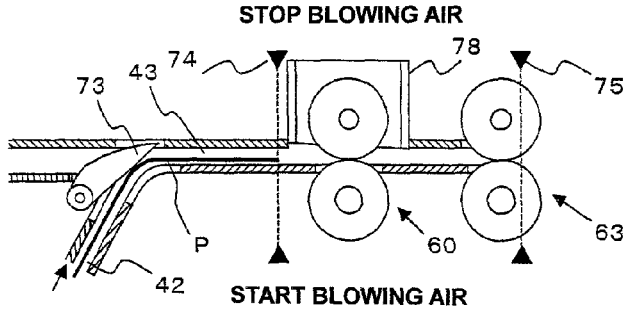
FIG. 7A to FIG. 7E are illustrative view showing conveyance and cooling down of a sheet in the case of being printed on a single-sided printing mode or on both sides with a duplex printing mode.
Figure 7B:
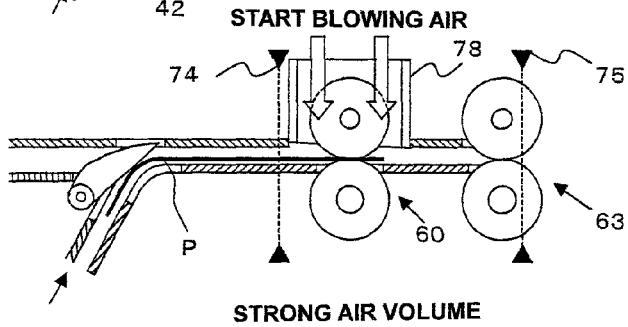
Figure 7C:
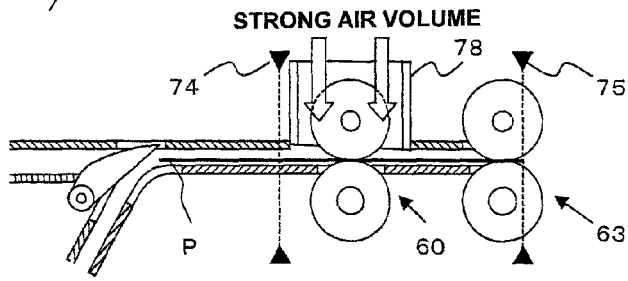
Figure 7D:
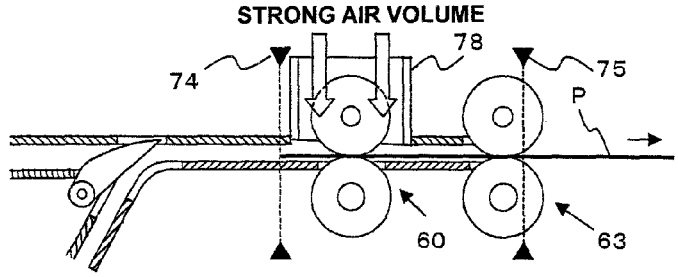
Figure 7E:
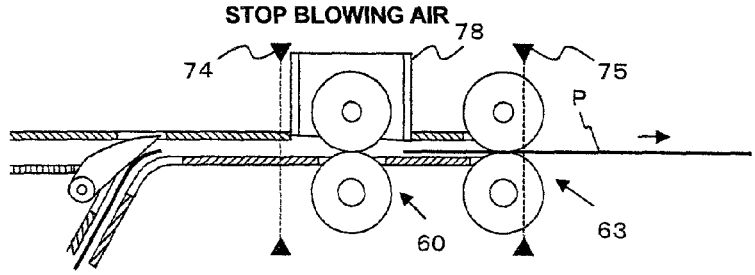
Figure 8A:
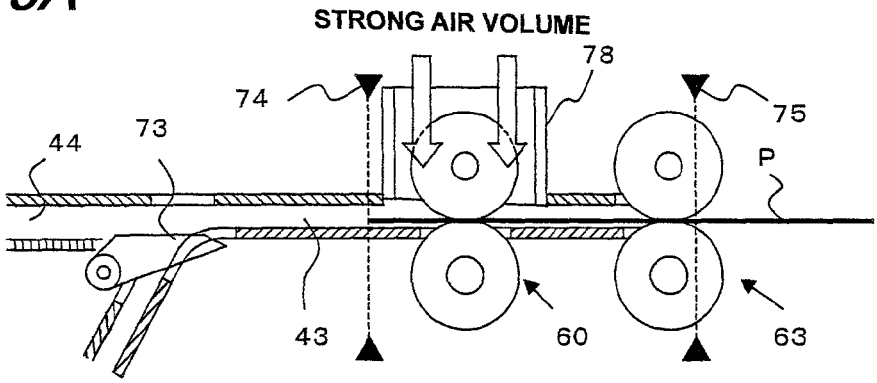
FIG. 8A to FIG. 8C are illustrative view showing conveyance and cooling down of a sheet in the case of single-sided printing of the duplex printing mode.
Figure 8B:
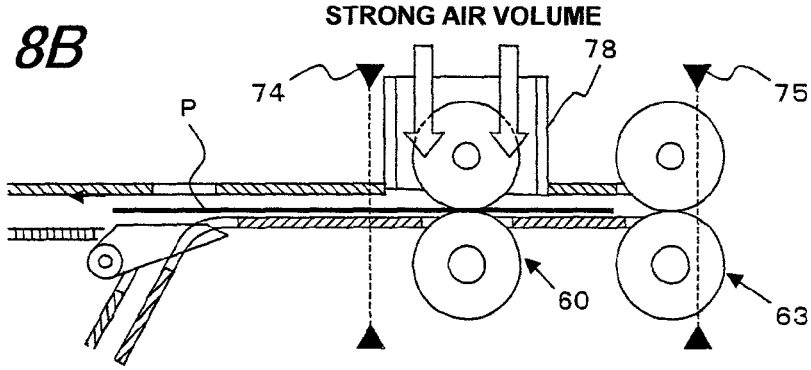
Figure 8C:
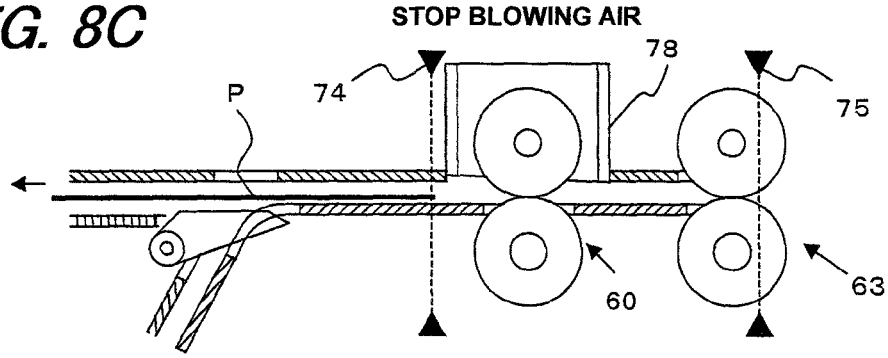

FIG. 6 is a flowchart showing procedures of cooling down of a sheet, FIG. 7A to FIG. 7E are illustrative view showing conveyance and cooling down of a sheet in the case of being printed on a single-sided printing mode or on both sides with a duplex printing mode, FIG. 8A to FIG. 8C are illustrative view showing conveyance and cooling down of a sheet in the case of single-sided printing with the duplex printing mode.

As shown in FIG. 7A, at starting of the conveyance of a sheet, the control portion 101 (FIG. 5) rotates the gate 73 upward and closes the sixth feed path 44 (FIG. 2) as the first position so that the first feed path 42 and the second feed path 43 are in communication with each other, conveyance of a sheet, which has been passed through the fixing unit 21 (FIG. 1), from the first feed path 42 to the second feed path 43 is started (step S1).

When the first sheet sensor 74 detects a tip end of the sheet (step S2; Yes), the control portion 101 receiving the detection signal sets a timer T1 (step S3).

That is, the first sheet sensor 74 is arranged on an upstream side of the sheet feed direction of the nip of the pair of feed rollers 60 which is on an outer side of the cooling duct 78, and thus the time from when the tip end of the sheet is detected by the sensor 74 up to when the tip end of the sheet is bitten into the nip of the first pair of feed rollers 60 serves as the timer T1.

The set value of the timer T1 has been registered in the storage portion 102 (FIG. 5) in advance and the control portion 101 reads it out from the storage portion 102 to set the timer T1.

Timer T1 is started (step S4), and when the timer T1 counts up a set value (predetermined time) (step S5; Yes), as shown in FIG. 7B, the control portion 101 (FIG. 5) starts to rotate the cooling fan 77 at a predetermined rotation speed to start blowing air at a predetermined cooling air volume (step S6). The setting value such as the rotation speed of the cooling fan 77 for securing the cooling air volume in this case has been stored in the storage portion 102 in advance, and the control portion 101 reads out the value to drive the cooling fan 77.

Blowing air by the cooling fan 77 is started in the state where the sheet is held between the first pair of feed rollers 60, and thereby curling up of the sheet, etc., by the blowing air at the time of being held by the nip between the first pair of feed rollers 60, is hard to occur and a defect in conveying performance is able to be prevented. The predetermined cooling air volume is a value in accordance with a type of a sheet (sheet size, sheet thickness, a grain direction of the sheet (a fiber direction is parallel to or orthogonal to the feed direction, etc.)), thereby preventing the defect in conveying performance. The setting value such as the rotation speed of the cooling fan 77 has been stored in the storing portion 102 in advance, and the value is read out by the control portion 101 in accordance with the type of the sheet for driving the cooling fan 77. Concerning the type of the sheet, in containing the sheet in a paper supply tray, a user may input from an operation portion, or the control portion 101 may automatically set by detection with the detection sensor.

In this embodiment, blowing air is started here for the first time, however, weak air may be blown from the starting of the conveyance of a sheet. In this case, the cooling air volume is to be increased to the predetermined volume in the state where the sheet is held between the first pair of feed rollers 60.

Conveyance of the sheet is continued, and as shown in FIG. 7C, the sheet P becomes a state of being held between the first pair of feed rollers 60 and the second pair of feed rollers 63. Then, the control portion 101 confirms whether the second sheet sensor 75 detects the tip end of the sheet (step S7).

When detection of the tip end of the sheet by the second sheet sensor 75 is confirmed (step S7; Yes), the control portion 101 switches the rotation speed of the cooling fan 77 to a high speed to further increase the blowing air volume so that the blowing air volume per unit time becomes high (step S8). In this manner, the cooling down effect is further improved, as well as the sheet is able to be conveyed stably since the sheet is held between both the first pair of feed rollers 60 and the second pair of feed rollers 63. The rotation speed of the cooling fan 77 in this case has also been registered in advance in the storage portion 102, and the control portion 101 drives the cooling fan 77 according to this value.

Next, as shown in FIG. 7D, the control portion 101 confirms whether the first sheet sensor 74 detects a rear end of the sheet P (step S9).

When the rear end of the sheet P is detected by the first sheet sensor 74 (step S9; Yes), the control portion 101 confirms whether or not a single-sided printing mode is operated (step S10).

In the case of the single-sided printing mode (step S10; Yes), a timer T2 is set (step S11). Here, the timer T2 sets a time from when the sensor 74 detects the rear end of the sheet P until when the sheet passes through the blowing out port 79 (FIG. 2).

The control section 101 starts the timer T2 (step S12) and confirms whether the timer T2 counts up the set value (step S13).

When the timer T2 counts up the set value (step S13; Yes), as shown in FIG. 7E, the blowing air is interrupted since the sheet P passes through the blowing out port 79 (step S14).

Whether all the sheets to be printed pass through the blowing out port 79 is confirmed (step S15), and when all the sheets have been passed through the blowing out port 79, processing is finished, and when not passed, the flow returns to the step S2 to perform conveyance of the remaining sheets P.

Furthermore, at the step S10, when the single-sided printing mode is not operated, confirmation is made on whether a sheet is the single-sided sheet P of the duplex printing mode at a step S16.

When it is not the single-sided sheet P of the duplex printing mode, the flow proceeds to the step S11 and the timer T2 is set.

When the sheet is the single-sided sheet P of the duplex printing mode, the first pair of feed rollers 60 and the second pair of feed rollers 63 are stopped (step S17), and as shown in FIG. 8A, the gate 73 is rotated downward to serve as the second position (step S18), and the second feed path 43 and the sixth feed path 44 are in communication with each other.

Then, as shown in FIG. 8B, the first pair of feed rollers 60 and the second pair of feed rollers 63 are reversely driven (step S19).

As shown in FIG. 8C, the control portion 101 (FIG. 5) confirms whether the first sheet sensor 74 detects the rear end of the sheet (step S20), and when detecting the rear end of the sheet, the flow proceeds to the step S14.

In this manner, before the tip end of the sheet is held by the nip of the first pair of feed rollers 60, cooling air is not blown or a cooling air volume is diminished, and when the sheet is held between the first pair of feed rollers 60, a predetermined air volume of the cooling air is blown in the vicinity of the nip of the first pair of feed rollers 60 or toward the first pair of feed rollers 60, and thereby the cooling of the sheet is able to be performed while preventing occurrence of conveyance defects of the sheet, such as curling up of the sheet by blowing air.

The sheet whose one side has been printed with the duplex printing mode is cooled down during a carrying-in period to the switchback path and during a carrying-out period from the switchback path, and thereby the sheet is able to be sufficiently cooled down and heat is not accumulated in the apparatus.

Furthermore, the cooling mechanism is provided in the second feed path 43 and departs from the fixing portion 21 (FIG. 1), and therefore an influence of the cooling air becomes small.

Second Embodiment

Figure 9:
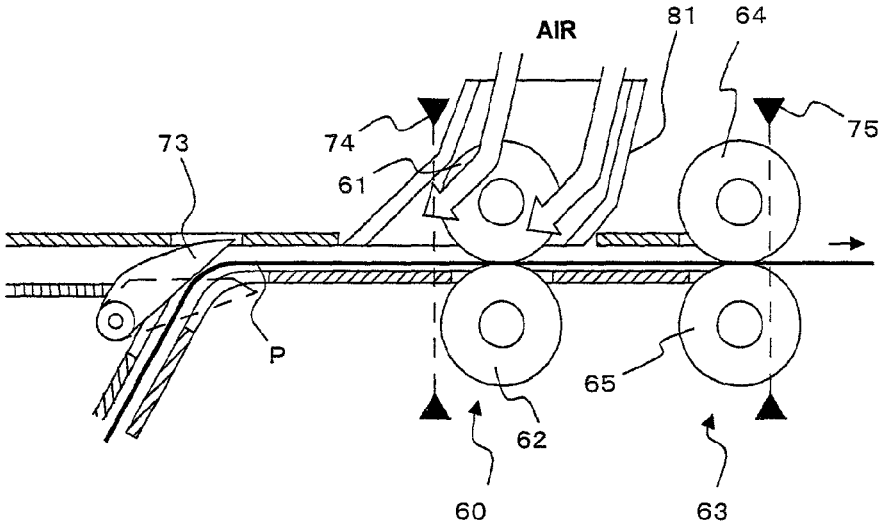
FIG. 9 is a configurational view showing a second embodiment of the cooling mechanism in the second feed path.

FIG. 9 is a configurational view showing a second embodiment of the cooling mechanism in the second feed path 43 (FIG. 7A).

Common reference numbers are attached to the same parts as the first embodiment in FIG. 2. The part different from the first embodiment is a shape of the cooling duct 81, and a side of the feed path of the cooling duct 81 is bent toward the upstream side of the sheet feed direction as shown in FIG. 9. Therefore, the cooling air is blown to the upstream side of the sheet feed direction from the first pair of feed rollers 60 along the cooling duct. The blowing air operation of the cooling air is the same as that of the first embodiment, therefore the description thereof is omitted.

In the present embodiment, at the time when the sheet is held between the pair of feed rollers, air is blown to a direction opposite to the feed direction of the sheet, and the air is thus flowed to the upstream side of the sheet feed direction from the feed tip end of the sheet, and therefore folding and twisting of the sheet further hardly occurs, and more stable conveyance is possible as well as the cooling effect is great.

Third Embodiment

Figure 10:
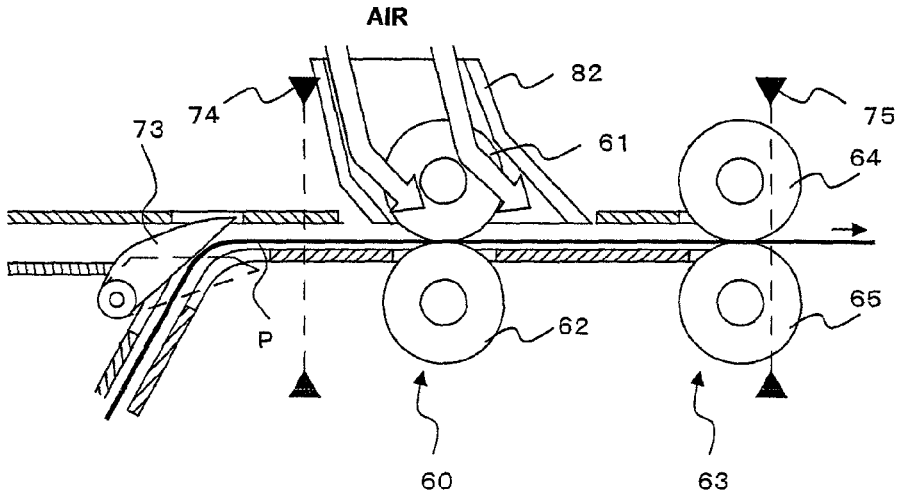
FIG. 10 is a configurational view showing a third embodiment of the cooling mechanism in the second feed path.

FIG. 10 is a configurational view showing a third embodiment of the cooling mechanism in the second feed path 43 (FIG. 7A).

Common reference numbers are attached to the same parts as the first embodiment in FIG. 2. The part different from the first embodiment is a shape of the cooling duct 82, and a side of the feed path of the cooling duct 82 is bent toward the downstream side of the sheet feed direction as shown in FIG. 10. Therefore, the cooling air is blown to the downstream side of the sheet feed direction from the first pair of conveyance feed rollers 60 along the cooling duct. The blowing air operation of the cooling air is the same as that of the first embodiment, therefore the description thereof is omitted.

In the present embodiment, the cooling air is further blown to the downstream side of the sheet feed direction in the state where the sheet is held between the first pair of feed rollers 60, and thereby folding and twisting of the sheet is prevented so that stable conveyance is possible as well as it is prevented from power being wasted for keeping the temperature of the fixing portion since air hardly flows into the fixing portion side which is arranged on the upstream side of the sheet feed direction.

Fourth Embodiment

Figure 11:
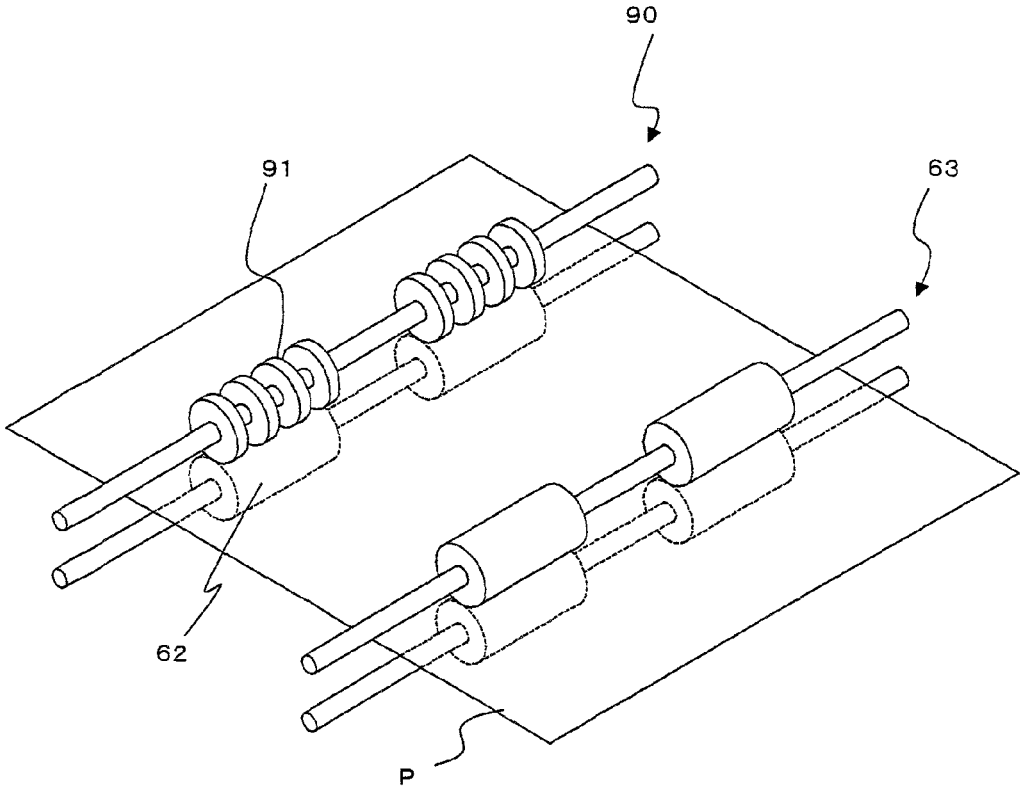
FIG. 11 is a perspective view showing a fourth embodiment of the cooling mechanism in the second feed path.

FIG. 11 is a perspective view showing a fourth embodiment of the cooling mechanism in the second feed path 43.

Common reference numbers are attached to the same parts as the first embodiment in FIG. 2. The part different from the first embodiment is a shape of the driven roller 61 of the first pair of feed rollers 60 (FIG. 3), and as shown in FIG. 11, a first pair of feed rollers 90 configures a driven roller 91 by combining a plurality of rollers each of which roller has a small width. Furthermore, the configuration may be made such that a roller whose roller diameter is large and a roller whose roller diameter is small are combined. Therefore the driven roller 91 has a structure that intermittently contacts a direction to which the shaft of the driven roller extends (axial direction), and alternately has a part in contact with the sheet and a part with a space between sheets.

In the first to third embodiments, there is a problem that the air from the cooling fan 77 is blocked by the driven roller 61, and thereby the cooling efficiency of the part of the sheet to which the air is difficult to be blown is degraded, and furthermore, the driven roller is subjected to become air resistance, and thus there is a need for higher blowing air pressure. In the fourth embodiment, air from the cooling fan 77 is blown from the void part provided in the roller toward the sheet, and therefore the cooling efficiency is able to be improved and the air resistance of the driven roller is able to be reduced, therefore there is no need of high blowing air pressure.

Note that, the present invention is not limited to the above-described embodiments, and the cooling mechanism provided in the second feed path 43 may only be a feed path after fixation and for example, may be provided on the first feed path (right after fixation feed path) 42 and the sixth feed path (duplex feed path) 44.

What is claimed is:

1. An image forming apparatus comprising:

an image forming portion that forms an image on a recording medium;

a fixing portion that heats and fixes an image on the recording medium after forming the image;

a feed path that conveys the recording medium after heating and fixing by the fixing portion;

a first pair of feed rollers composed of two feed rollers provided in the feed path; and a cooling mechanism that sends cooling air to a nip portion of the pair of feed rollers or to the vicinity thereof, wherein the cooling mechanism includes a cooling fan that blows the cooling air and a cooling duct that guides the cooling air to the first pair of feed rollers, the cooling mechanism increases a cooling air volume when the recording medium is held between the first pair of feed rollers in comparison to the time when the recording medium is not held between the first pair of feed rollers, and the cooling duct rotatably and integrally supports a driven roller which is one feed roller of the first pair of feed rollers.

2. The image forming apparatus according to claim 1, wherein a second pair of feed rollers is provided on a downstream side of a feed direction of the recording medium with respect to the first pair of feed rollers, and the cooling air volume is further increased when the recording medium is held between the first and the second pair of feed rollers.

3. The image forming apparatus according to claim 1, wherein the cooling mechanism changes the cooling air volume depending on a type of the recording medium.

4. The image forming apparatus according to claim 1, wherein the cooling mechanism blows the cooling air so as to be blown toward the upstream side of the feed direction with respect to the first pair of feed rollers.

5. The image forming apparatus according to claim 1, wherein a feed roller of the first pair of feed rollers, which is located on the side to which the cooling air blows, has a structure alternately having a part in contact with the recording medium and a part with a space from the recording medium thereto.

6. The image forming apparatus according to claim 1, wherein the feed path includes a right after fixation feed path that conveys the recording medium right after heating and fixing by the fixing portion and a discharge feed path that connects to the right after fixation feed path to convey to an output port, and the first pair of feed rollers is provided in the discharge feed path.

7. The image forming apparatus according to claim 6, wherein the discharge feed path is also connected to a duplex feed path for performing duplex printing to be used as a switchback path, and a recording medium whose one side is printed with a duplex printing mode is cooled down during a carrying-in period to the switchback path and during a carrying-out period from the switchback path.

8. The image forming apparatus according to claim 6, wherein the right after fixation feed path extends in an approximately vertical direction from the fixing portion, and the discharge feed path is arranged in an approximately horizontal direction to connect to the right after fixation feed path.

9. The image forming apparatus according to claim 6, wherein in the discharge feed path, a predetermined length of a plane part of the feed path is provided between a connection portion to the right after fixation feed path and an installation position of the first pair of feed rollers.

10. An image forming apparatus comprising:

an image forming portion that forms an image on a recording medium;

a fixing portion that heats and fixes an image on the recording medium after forming the image;

a feed path that conveys the recording medium after heating and fixing by the fixing portion;

a first pair of feed rollers composed of two feed rollers provided in the feed path;

a second pair of feed rollers provided on a downstream side of a feed direction of the recording medium with respect to the first pair of feed rollers; and a cooling mechanism that sends cooling air to a nip portion of the first pair of feed rollers, wherein the cooling mechanism increases a cooling air volume when the recording medium is held between the first pair of feed rollers, not between the second pair of feed rollers, in comparison to the time when the recording medium is not held between the first pair of feed rollers.

11. An image forming apparatus comprising:

an image forming portion that forms an image on a recording medium;

a fixing portion that heats and fixes an image on the recording medium after forming the image;

a feed path that conveys the recording medium after heating and fixing by the fixing portion;

two pairs of feeding rollers provided in the feed path and made up of a first pair of feed rollers provided on a side of the fixing portion in a feed direction and a second pair of feed rollers provided on a downstream side with respect to the first pair of feed rollers; and a cooling mechanism that sends cooling air to a nip portion of the pair of the first feed rollers or to the vicinity thereof, wherein, in a case where the recording medium is conveyed on the feed path after fixing, when the recording medium is held only between the first pair of feed rollers, the cooling mechanism increases a cooling air volume in comparison to the time when the recording medium is not held between the first pair of feed rollers, and when the recording medium is held between the first pair of feed rollers and between the second pair of feed rollers, the cooling mechanism further increases the cooling air volume, and when the recording medium is held only between the second pair of feed rollers, the cooling mechanism reduces the cooling air volume to a volume in a case that the recording medium is not held between the first pair of feed rollers.

* * * * *